US009487326B2

(12) United States Patent
Banik et al.

(10) Patent No.: US 9,487,326 B2
(45) Date of Patent: Nov. 8, 2016

(54) BULK BIN WITH PANEL TO PANEL INTERLOCK FEATURES

(71) Applicant: ORBIS Corporation, Oconomowoc, WI (US)

(72) Inventors: Joachim Banik, Oconomowoc, WI (US); Link Jay Greiveldinger, Menomonee Falls, WI (US); Leslie Allen Wagner, Mukwonago, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/548,493

(22) Filed: Nov. 20, 2014

(65) Prior Publication Data

US 2015/0144625 A1 May 28, 2015

Related U.S. Application Data

(60) Provisional application No. 61/908,938, filed on Nov. 26, 2013.

(51) Int. Cl.

| | |
|---|---|
| ***B65D 6/18*** | (2006.01) |
| ***B65D 6/08*** | (2006.01) |
| ***B65D 6/34*** | (2006.01) |
| *B65D 19/18* | (2006.01) |

(52) U.S. Cl.

CPC ..... *B65D 11/14* (2013.01); *B65D 11/1833* (2013.01); *B65D 11/26* (2013.01); *B65D 19/18* (2013.01); *B65D 2519/009* (2013.01)

(58) Field of Classification Search

CPC ... B65D 11/14; B65D 11/18; B65D 11/1833; B65D 19/06; B65D 19/20; B65D 19/08; B65D 19/12; B65D 19/16; B65D 2519/009; B65D 19/18

USPC ..... 220/6, 7

See application file for complete search history.

(56) References Cited

U.S. PATENT DOCUMENTS

| | | | |
|---|---|---|---|
| 489,711 | A | 1/1893 | Mandioni |
| 1,039,452 | A | 9/1912 | Shepard |

(Continued)

FOREIGN PATENT DOCUMENTS

| | | | |
|---|---|---|---|
| CA | 1319118 | A1 | 6/1993 |
| CA | 2665281 | A1 | 11/2009 |

(Continued)

OTHER PUBLICATIONS

European Patent Office, Extended European Search Report for EP 14194964, mailed Mar. 27, 2015 (6 pages).

(Continued)

*Primary Examiner* — Anthony Stashick
*Assistant Examiner* — Mollie Llewellyn
(74) *Attorney, Agent, or Firm* — Nixon Peabody LLP

(57) ABSTRACT

A collapsible bulk bin container with structures for improved strength is provided. The bulk bin container includes wrap-around portions in the short sidewalls with a horizontal top plate and a horizontal rib proximate the top plate. The bulk bin container also includes ramp structure in the long side sidewall and base for lifting and dropping the sidewall when pivoted upright. The upright sidewall and base include surfaces to inhibit or prevent buckling due to compressive loads. The bin can also include post and pocket interlock structures.

18 Claims, 4 Drawing Sheets

(56) References Cited

U.S. PATENT DOCUMENTS 1,280,629 A 10/1918 Appleby
1,381,013 A 6/1921 Rainsford
1,883,553 A 10/1932 Chain
2,579,655 A 12/1951 Donald
3,246,828 A 4/1966 Branscum et al.
3,572,535 A 3/1971 Kinzie
3,628,683 A 12/1971 Friedrich et al.
3,692,342 A 9/1972 Scallan
3,747,794 A 7/1973 Bitney
3,870,185 A 3/1975 Sanders et al.
3,874,546 A 4/1975 Sanders et al.
3,924,293 A 12/1975 Cain
3,977,044 A 8/1976 Mort
4,044,910 A 8/1977 Box
4,063,330 A 12/1977 Triplette
4,089,417 A 5/1978 Osborne
4,119,263 A 10/1978 Cuthbertson et al.
4,163,495 A * 8/1979 Drader ..... B65D 11/1833 206/506
4,186,841 A 2/1980 Buckley et al.
4,192,430 A 3/1980 Cornou
4,300,695 A 11/1981 Hsu
4,349,121 A 9/1982 Lafferty
4,454,946 A 6/1984 Yokowo
4,466,541 A 8/1984 Tabler et al.
4,491,231 A 1/1985 Heggeland et al.
4,571,774 A 2/1986 Hinson
4,591,065 A 5/1986 Foy
4,674,647 A 6/1987 Gyenge et al.
4,765,480 A 8/1988 Malmanger
4,775,068 A 10/1988 Reiland et al.
4,798,304 A 1/1989 Rader
4,828,132 A 5/1989 Francis, Jr. et al.
4,863,062 A 9/1989 Holliday
4,917,255 A 4/1990 Foy et al.
4,923,079 A 5/1990 Foy
4,960,223 A 10/1990 Chiang et al.
4,967,927 A 11/1990 Reiland et al.
4,987,639 A 1/1991 Baiuley et al.
5,094,356 A 3/1992 Miller
5,114,037 A 5/1992 Hillis et al.
5,150,806 A 9/1992 Glomski
5,199,592 A 4/1993 Reiland et al.
5,289,935 A 3/1994 Hillis et al.
5,398,835 A 3/1995 Blinstrub
5,467,885 A 11/1995 Blinstrub
5,474,197 A 12/1995 Hillis et al.
5,501,353 A 3/1996 Warren
5,535,482 A 7/1996 Grabber
5,538,178 A 7/1996 Zink et al.
5,586,675 A 12/1996 Borsboom et al.
5,632,392 A 5/1997 Oh
D381,513 S 7/1997 Brauner
5,660,291 A 8/1997 Dash
5,673,791 A 10/1997 Jamison
5,711,444 A 1/1998 Meacham et al.
5,725,119 A 3/1998 Bradford et al.
5,769,230 A 6/1998 Koefelda
5,788,103 A 8/1998 Wagner et al.
5,797,508 A 8/1998 Loftus et al.
5,845,799 A 12/1998 Deaton
5,850,935 A 12/1998 Luburic et al.
5,897,012 A 4/1999 Sortwell
5,908,135 A 6/1999 Bradford et al.
5,938,059 A 8/1999 Luburic
5,975,324 A 11/1999 Schmitt
6,000,604 A 12/1999 Lapoint, III
6,015,056 A 1/2000 Overholt et al.
6,029,839 A 2/2000 Mansouri
6,029,840 A 2/2000 Brauner
6,062,410 A 5/2000 Bradford et al.
6,088,239 A 7/2000 Zeiss
6,135,287 A 10/2000 Hartwall
6,138,851 A 10/2000 Townson
6,186,932 B1 2/2001 Vallot
6,189,695 B1 2/2001 Ching-rong
6,209,742 B1 4/2001 Overholt et al.
6,216,872 B1 4/2001 Haasbroek
6,216,899 B1 4/2001 Vicari
6,223,903 B1 5/2001 Mansouri
6,230,916 B1 5/2001 Bradford et al.
6,234,315 B1 5/2001 Karpisek
6,243,920 B1 6/2001 Sauve
6,283,319 B1 9/2001 Hillis et al.
6,290,081 B1 9/2001 Merey
6,293,417 B1 9/2001 Varfeldt
6,293,418 B1 9/2001 Ogden et al.
6,305,566 B1 10/2001 Pigott et al.
6,305,726 B1 10/2001 LeTrudet
D452,614 S 1/2002 Overholt
6,367,630 B1 4/2002 Elskamp
6,386,388 B1 5/2002 Overholt
6,398,054 B1 6/2002 Overholt et al.
6,405,888 B1 6/2002 Overholt et al.
6,415,938 B1 7/2002 Karpisek
6,416,271 B1 7/2002 Pigott et al.
6,422,409 B2 7/2002 Kofod
6,446,825 B1 9/2002 Godoy
6,460,717 B1 10/2002 Smyers et al.
6,484,898 B2 11/2002 Hillis et al.
RE37,915 E 12/2002 Lapoint, III
6,540,096 B1 4/2003 Bazany et al.
6,543,659 B2 4/2003 Blair
6,601,724 B1 8/2003 Koefelda et al.
6,631,822 B1 10/2003 Overholt
6,669,044 B2 12/2003 Murakami et al.
6,691,885 B2 2/2004 Brown
6,726,046 B2 4/2004 Orset
6,776,300 B2 8/2004 Walsh et al.
6,783,032 B2 8/2004 Fons
6,783,058 B2 8/2004 Quaintance
6,786,394 B2 9/2004 Prince
6,805,254 B2 10/2004 Tanzer et al.
6,820,761 B1 11/2004 Mouri et al.
6,838,616 B2 1/2005 Harrison et al.
6,863,180 B2 3/2005 Apps et al.
6,868,979 B2 3/2005 Rader
6,877,628 B2 4/2005 Nesting
6,899,242 B2 5/2005 Overholt et al.
6,902,061 B1 6/2005 Elstone
6,918,502 B1 7/2005 Overholt et al.
6,955,273 B2 10/2005 Hartwall
6,966,449 B2 11/2005 Williams
7,011,225 B2 3/2006 Oster et al.
7,017,765 B2 3/2006 Overholt
7,017,766 B2 3/2006 Hsu et al.
7,032,765 B2 4/2006 Miller et al.
7,044,319 B2 5/2006 Overholt et al.
7,048,135 B2 5/2006 Smyers et al.
7,059,489 B2 6/2006 Apps et al.
7,063,223 B2 6/2006 Iwahara et al.
7,083,369 B2 8/2006 Nyeboer
7,100,786 B2 9/2006 Smyers
7,104,414 B2 9/2006 Apps et al.
7,128,209 B2 10/2006 Bringard et al.
7,128,231 B2 10/2006 Overholt
7,137,522 B2 11/2006 Dubois
7,156,249 B2 1/2007 Heinrichs
7,159,730 B2 1/2007 Rumple
7,195,127 B2 3/2007 Hsu et al.
7,258,232 B2 8/2007 Bradford et al.
7,264,122 B2 9/2007 Koefelda et al.
7,287,661 B2 10/2007 Knutsson et al.
7,311,220 B2 12/2007 Kellerer
7,331,480 B1 2/2008 Nolan
7,347,328 B2 3/2008 Hartwall
7,357,269 B2 4/2008 Apps
7,357,271 B2 4/2008 Hase et al.
7,370,771 B2 5/2008 Rader
7,416,092 B2 8/2008 Dubois et al.
7,438,197 B2 10/2008 Yamauchi
7,478,734 B2 1/2009 Vargas
7,484,634 B2 2/2009 Apps
7,540,390 B2 6/2009 Bublitz et al.

(56) References Cited

U.S. PATENT DOCUMENTS

| | | | |
|---|---|---|---|
| 7,549,550 | B2 | 6/2009 | Smyers et al. |
| 7,556,165 | B2 | 7/2009 | McDade |
| 7,556,166 | B2 | 7/2009 | Parnall et al. |
| 7,708,160 | B2 | 5/2010 | Booth et al. |
| 7,748,330 | B2 | 7/2010 | Dubois et al. |
| 7,774,919 | B2 | 8/2010 | Bublitz et al. |
| 7,828,167 | B2 | 11/2010 | Nolan |
| 7,841,487 | B2 | 11/2010 | Miller et al. |
| 7,861,458 | B2 | 1/2011 | Apps et al. |
| 7,870,970 | B2 | 1/2011 | Fisk |
| 8,109,402 | B2 | 2/2012 | Hartwall |
| 8,181,806 | B2 | 5/2012 | Hidalgo Vargas |
| 8,210,379 | B2 | 7/2012 | Afflerbach et al. |
| 8,267,270 | B2 | 9/2012 | Samprathi |
| 8,308,015 | B2 | 11/2012 | Bradford et al. |
| 8,413,831 | B2 | 4/2013 | Nolan |
| 8,434,618 | B2 | 5/2013 | Mitchell et al. |
| 8,485,376 | B2 | 7/2013 | Samprathi |
| 8,511,506 | B2 | 8/2013 | Ringler |
| 8,727,158 | B2 | 5/2014 | Nolan |
| 8,727,165 | B2 | 5/2014 | Nolan |
| 8,820,558 | B2 | 9/2014 | Van der Korput et al. |
| 8,820,560 | B2 | 9/2014 | Nolan |
| 2002/0108950 | A1 | 8/2002 | Moorman et al. |
| 2004/0065699 | A1 | 4/2004 | Schoer et al. |
| 2005/0103797 | A1 | 5/2005 | Rader et al. |
| 2006/0011627 | A1 | 1/2006 | Overholt et al. |
| 2007/0029319 | A1 | 2/2007 | Speck |
| 2007/0056967 | A1 | 3/2007 | Dobrinski et al. |
| 2007/0056977 | A1 | 3/2007 | Dobrinski et al. |
| 2007/0068941 | A1 | 3/2007 | Dubois |
| 2007/0075077 | A1 | 4/2007 | Dubois |
| 2007/0095842 | A1 | 5/2007 | Apps |
| 2007/0140684 | A1 | 6/2007 | Tsang |
| 2007/0181587 | A1 | 8/2007 | Burnham |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0017638 | A1 | 1/2008 | Bradford |
| 2008/0116199 | A1 | 5/2008 | Bublitz et al. |
| 2008/0116201 | A1 | 5/2008 | Baltz |
| 2008/0169285 | A1 | 7/2008 | Marazita et al. |
| 2010/0018966 | A1 | 1/2010 | Roberts, Sr. et al. |
| 2010/0038331 | A1 | 2/2010 | Ydstrom |
| 2010/0072199 | A1 | 3/2010 | Manuel |
| 2010/0239730 | A1 | 9/2010 | Ditter |
| 2010/0275426 | A1 | 11/2010 | Bublitz et al. |
| 2011/0127275 | A1 | 6/2011 | Dubois |
| 2011/0139775 | A1 | 6/2011 | Nolan |
| 2011/0259884 | A1 | 10/2011 | Kellerer et al. |
| 2012/0152798 | A1 | 6/2012 | Allegretti et al. |
| 2012/0205369 | A1 | 8/2012 | Nolan |
| 2012/0318692 | A1 | 12/2012 | Kellerer |
| 2013/0048522 | A1 | 2/2013 | Lorenz et al. |
| 2013/0221003 | A1 | 8/2013 | Carver et al. |
| 2014/0042175 | A1 | 2/2014 | Nolan |
| 2014/0117035 | A1 | 5/2014 | Petersen et al. |
| 2014/0252018 | A1 | 9/2014 | Nolan |

FOREIGN PATENT DOCUMENTS

| | | | |
|---|---|---|---|
| CN | 200930355382.X | | 7/2010 |
| CN | 200930355383.4 | | 7/2010 |
| CN | 200930355384.9 | | 7/2010 |
| CN | 201020111642.6 | | 11/2010 |
| CN | 201020145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 2/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0768229 | B1 | 7/1999 |
| EP | 0962396 | A1 | 12/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1652646 | A2 | 5/2006 |
| EP | 1440011 | B1 | 6/2006 |
| EP | 1472147 | B1 | 9/2006 |
| EP | 1746036 | A1 | 1/2007 |
| EP | 1827942 | A2 | 9/2007 |
| EP | 1927552 | A2 | 6/2008 |
| EP | 1935792 | A1 | 6/2008 |
| EP | 1616803 | B1 | 10/2009 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| JP | 03381677 | A | 12/2002 |
| KR | 1999-0061830 | | 7/1999 |
| SE | 323908 | B | 5/1970 |
| SE | 522095 | C2 | 1/2004 |
| WO | 9640564 | A1 | 12/1996 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |
| WO | 2009023830 | A1 | 2/2009 |

OTHER PUBLICATIONS

International Search Report for PCT/US08/73306 mailed Nov. 24, 2008 (2 pages).

International Search Report for PCT/US2013/067243 mailed Feb. 7, 2014 (3 pages).

International Preliminary Report on Patentability and Written Opinion of International Searching Authority for PCT/US2008/073306 mailed Feb. 16, 2010 (6 pages).

Written Opinion of International Searching Authority for PCT/US2013/067243 mailed Feb. 7, 2014 (4 pages).

European Patent Office, Examination Report for EP 14194964, mailed Mar. 30, 2016 (4 pages).

* cited by examiner

BULK BIN WITH PANEL TO PANEL INTERLOCK FEATURES

CROSS-REFERENCE TO RELATED APPLICATIONS

The present application claims the benefit of U.S. Provisional Patent Application No. 61/908,938 filed Nov. 26, 2013, which is incorporated herein in its entirety by reference.

FEDERALLY SPONSORED RESEARCH OR DEVELOPMENT

N/A

FIELD OF THE INVENTION

The present invention is generally directed toward a bulk bin container with improved performance features, and in particular, a bulk bin including a horizontal top plate in the wrap-around sidewall portions combined with ramp surfaces for lifting and locking the sidewall in an upright position and/or post and pocket interlocks to provide additional support for the sidewalls.

DESCRIPTION OF THE PRIOR ART

Plastic bulk bin containers typically consist of a base and four hingeably connected sidewalls. The sidewalls are in an approximately horizontal position when the bulk container is in a collapsed state, and in a vertical position when the container is erected to receive shipping goods. The sidewalls can have features along each side that interlock with adjacent sidewalls when containers are erected. Most bulk bin containers are designed to stack on each other in the erected state, with and without the use of top caps.

The sidewalls of certain bulk bins are pivotably connected to a base portion by fixed hinge axes. Some of these bulk bins include wrap-around portions on two opposing sidewalls with a top plate. The other two sidewalls are typically slammed upright into the wrap-around portions. Such top plates have not been previously used with sidewalls that do not have a fixed axis, such as those with a lift and lock or post and pocket design.

Compressive forces caused by stacking bulk bin containers (especially when filled) can cause buckling and other structural damage to the container. The present invention provides a bulk bin container with improved strength to counter compressive forces.

The present invention is described below and shown in the Figures.

SUMMARY OF THE INVENTION

The present invention is directed to a collapsible bulk bin container with improved sidewall features. The bulk bin combines a wrap-around feature with a top plate (and in some cases a rib positioned proximate the top plate) with an adjacent sidewall having a lift and lock design and/or a post and pocket design.

In accordance with a first embodiment, a collapsible bulk bin container with improved corner support structure on a sidewall is provided to interact with an adjacent sidewall having a lift and lock design. The bulk bin container comprises a base having a first side, a second side, a third side and a fourth side. A first sidewall is pivotably connected to the first side of the base, a second sidewall is pivotably connected to the second side of the base adjacent the first sidewall, a third sidewall is pivotably connected to the third side of the base opposing the first sidewall, and a fourth sidewall is pivotably connected to the fourth side of the base adjacent the third sidewall on one side of the fourth sidewall and adjacent the first sidewall on an opposing side of the fourth sidewall. The first sidewall includes a first wrap-around portion at a first side of the first sidewall that contacts a first side portion of the second sidewall when the first and second sidewalls are pivoted upright. The first wrap-around portion includes a first horizontal plate at a top portion of the first wrap-around portion extending outward over the first wrap-around portion.

The second (and typically the fourth—i.e., opposing sides) sidewall does not include a fixed hinge axis. Instead, the second sidewall has a floating hinge that allows for a lift and lock design where the sidewall is lifted upward as it is pivoted into a vertical (i.e., erect) position and, near or at the vertical position, is moved downward to lock the sidewall into place. As described herein, ramps on the bottom of the sidewall and the base can be coordinated to achieve the lift and lock features.

Alternatively, or in addition to the lift and lock feature, the sidewalls can have a post and pocket structure. The post and pocket features interact along the edges of the sidewalls to provide a strong connection.

The first sidewall can also include a second wrap-around portion at a second side of the first sidewall that contacts a first side portion of the fourth sidewall when the first and fourth sidewalls are pivoted upright. The second wrap-around portion also includes a second horizontal plate at a top portion extending outward over the second wrap-around portion.

The collapsible bulk bin container can also comprise a horizontal rib in the first wrap-around portion positioned below the first horizontal plate. The rib is positioned proximate the top portion of the first wrap-around portion. Similarly, a horizontal rib is provided in the second wrap-around portion positioned below the second horizontal plate proximate the top portion of the second wrap-around portion.

The wrap-around portions extend at approximately right angles (90°) to the sidewall and include structures (such as projections, or "post and pocket" structures) that interact with structures on the edge of the adjacent sidewall to interlock the sidewalls.

The bulk bin container can include the third sidewall having a first wrap-around portion at a first side of the third sidewall that contacts a second side portion of the second sidewall when the third and second sidewalls are pivoted upright. The first wrap-around portion of the third sidewall having a third horizontal plate extending outward over the first wrap-around portion at a top portion of the first wrap-around portion. Similar to the first sidewall, the third sidewall also includes a second wrap-around portion at a second side of the third sidewall that contacts a second side portion of the fourth sidewall when the third and fourth sidewalls are pivoted upright. The second wrap-around portion of the third sidewall having a fourth horizontal plate extending outward over the second wrap-around portion at a top portion of the second wrap-around portion.

Again, similar to the first sidewall, the first wrap-around and second wrap-around portions of the third sidewall each include a horizontal rib positioned below the horizontal plate proximate the top portion of the wrap-around portions.

In accordance with another aspect of the invention, a collapsible bulk bin container having sidewalls with ramp surfaces for lifting and locking one or more sidewalls is provided. The bulk bin container comprises a base having an upward projection along a first side, and a first long side sidewall pivotably connected to the first side of the base by a floating hinge. The first long side sidewall having a first lower edge portion with a first ramp surface and the upward projection having a first upper edge portion with a second ramp surface positioned to contact the first ramp surface of the first long sidewall. The first ramp surface and second ramp surface configured to initially lift the first long sidewall as the first long sidewall is pivoted into an upright position. A similar configuration can be used for the short sidewalls or any sidewalls for bins having four equal sidewalls.

The first ramp surface of the first lower edge portion of the first long sidewall can be curved. Similarly, the second ramp surface of the first upper edge portion of the upward projection of the first side of the base can be curved.

Additionally, the first upper edge portion of the upward projection along the first side of the base can have an outwardly vertical surface connected to the second ramp surface. The first lower edge portion of the first long sidewall has an inwardly vertical surface connected to the first ramp surface.

The first long side sidewall can also include a second lower edge portion spaced from the first lower edge portion with a first ramp surface. The upward projection can have a corresponding second upper edge portion spaced from the first upper edge portion with a second ramp surface positioned to contact the first ramp surface of the second lower edge portion of the first long sidewall.

The first lower edge portion of the first long sidewall and the first upper edge portion of the upward projection along the first side of the base can be positioned proximate a first corner of the base. Similarly, the second lower edge portion of the first long sidewall and the second upper edge portion of the upward projection along the first side of the base can be positioned proximate a second corner of the base. Additional corresponding lower and upper edge portions (with ramp surfaces) can be positioned between the first and second edge portions.

The base can include a second upward projection and second long side sidewall with ramp structures described.

Further aspects of the invention are disclosed below and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
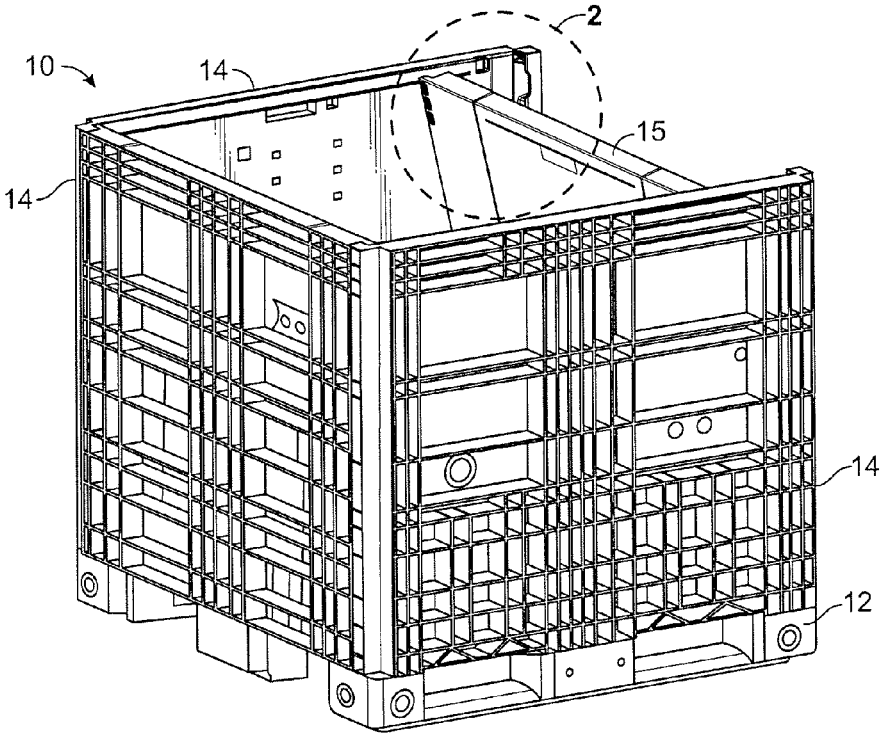
FIG. 1 is a perspective view of bulk bin container having a horizontal wrap-around plate in accordance with one aspect of the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

In accordance with a first aspect of the present invention, a collapsible bulk bin container is provided with an improvement to features utilized for interlocking the sidewalls. Specifically, the bulk bin container is provided with an upper, horizontal plate to the wrap-around sections of the short sidewalls. This increases the strength of the container, and in particular, the corner portions of the container when the sidewalls are in an upright and locked position.

Referring to FIG. 1, a bulk bin container 10 is shown having a base 12 and four collapsible sidewalls (also sometimes referred to as "panels") 14, 15. Three of the sidewalls 14 are shown in an upright position and a fourth sidewall 15 is shown just prior to being upright.

The bulk bin container 10 is configured so that two of the sidewalls 14 include projections or wrap-around portions 18 on both sides of the sidewall that allow the sidewall 14 to interlock with adjacent sidewalls. Referring to the enlarged corner view of FIG. 2, the wrap-around portion 18 extends at approximately a right angle (i.e., 90°) to the sidewall. The wrap-around portion 18 forms an inwardly facing pocket and includes a plurality of projections that mate with projections on the edge of the adjacent sidewall to interlock the two sidewalls in the upright position. The interlocking features can be, for example, a "post-and-pocket" structure or a "lift-and-lock" structure.

The bulk bin container 10 includes two larger opposing sidewalls and two shorter opposing sidewalls. The wrap-around portions 18 are typically located on the shorter sidewalls (however, the present invention can be utilized if the longer sidewalls include the wrap around portions, or for containers having equal sidewalls).

Figure 2:
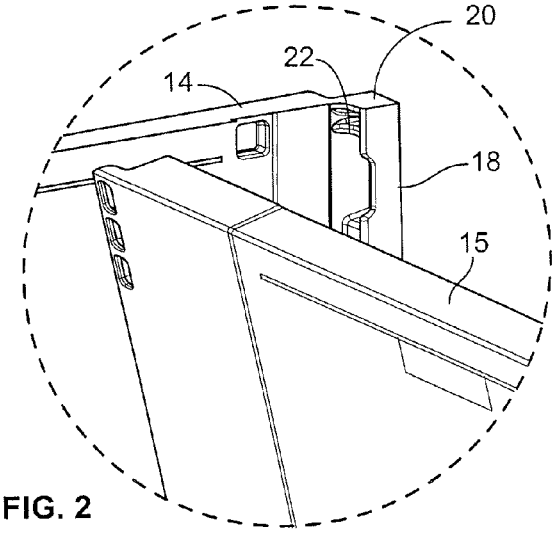
FIG. 2 is an enlarged perspective view of a corner portion of the bulk bin container of FIG. 1.
Figure 3:
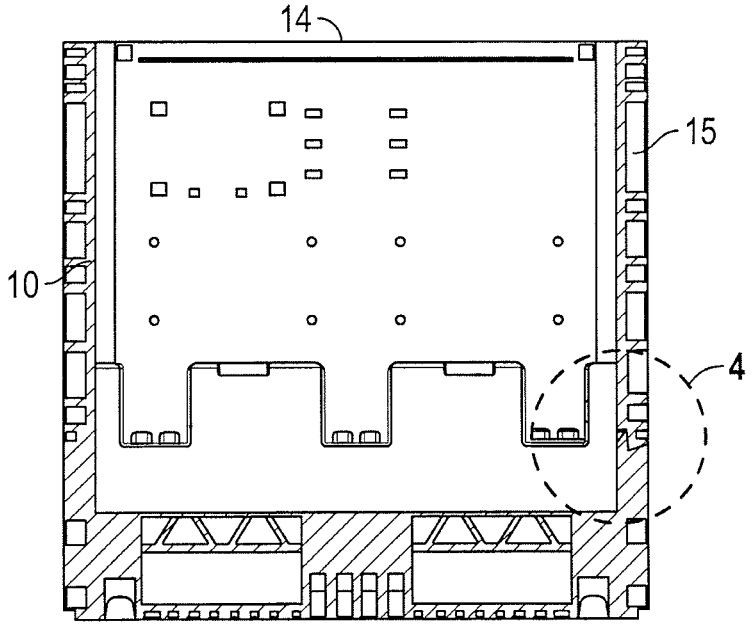
FIG. 3 is a cross-sectional view of bulk bin container with a sidewall ramp and bottom ramp in accordance with another aspect of the present invention.

The wrap-around portions 18 (one of which is shown in FIG. 2) include a horizontal plate 20 positioned at the top of the wrap-around portion 18. A horizontal rib 22 is positioned just below the horizontal plate 20 proximate the top of the wrap-around portion 18.

As illustrated in FIGS. 3-6, the bulk bin container 10 also includes features which lift the long sidewall 15 as it is pivoted upward. In particular, the container 10 is provided with ramps having ramp surfaces, molded into the panel and into the base, which cooperate to lift the panel approximately 0.75 inches upward as the panel is moved into an upright position. Once the panel is upright or nearly upright, it can then be forced downward and locked. This allows interlocking structure on the edge of the panel to engage corresponding structure of a wrap-around section of an adjacent panel as discussed above. The ramps are located above the hinge rotation centerlines. While near the edge, the ramps are moved inward from the exterior edge or surface of the bulk bin container 10 (i.e., towards the center of the base). This inward location provides an additional benefit of counteracting buckling of the panel when the bulk bin container 10 is subjected to compressive loads from stacking The resistance against buckling is accomplished by a vertical surface on the ramp in the base which contacts a parallel vertical surface on the panel.

Figure 4:
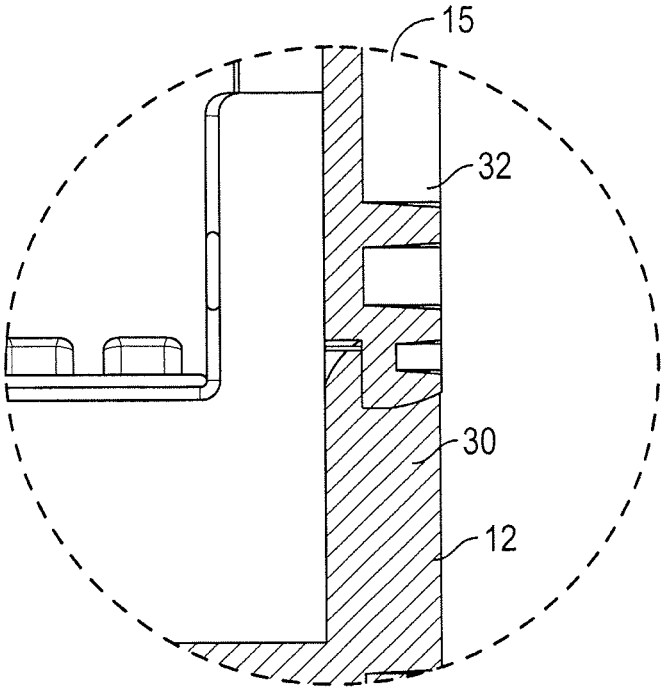
FIG. 4 is an enlarged cross-sectional view of a corner portion of the bulk bin container of FIG. 3.
Figure 5:
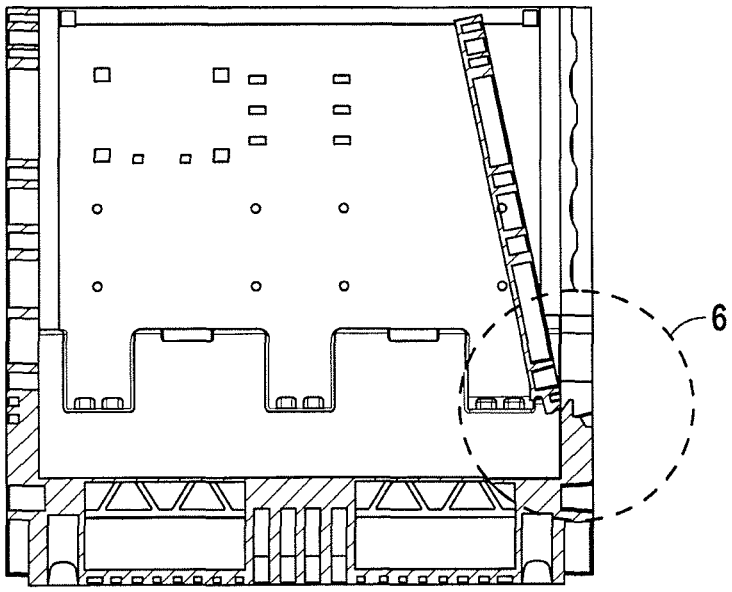
FIG. 5 is a cross-sectional view of the bulk bin container with a sidewall partially lowered.
Figure 6:
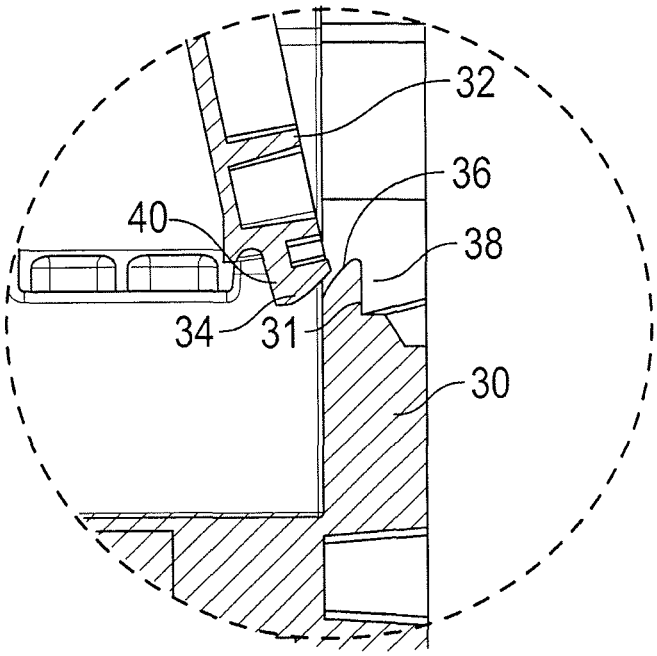
FIG. 6 is an enlarged cross-sectional view of a corner portion of the bulk bin container of FIG. 5; and, FIG. 7 is a perspective view of a corner of the bulk bin container showing the bottom ramp with a partially collapsed sidewall.

Referring to FIGS. 4 and 6, the base 12 includes a first upward projection 30 along a side of the base 12 aligned with the long side sidewall 15. The first upward projection includes a first upper edge portion 31. The first long side sidewall 15 has a first lower edge portion 32 with a first lower ramp surface 34. The first lower ramp surface 34 is positioned to engage a second ramp surface 36 positioned at a top of the first upper edge portion 31. The first ramp surface 34 and the second ramp 36 surface are preferably curved.

The first ramp surface 34 and second ramp surface 36 are designed to engage during pivoting of the sidewall 15 and cause the sidewall to lift upward. The sidewall 15 is provided with a floating hinge (not shown) to accommodate the upward movement of the sidewall 15.

As the sidewall 15 is moved more upright, the first ramp surface 34 passes the second ramp surface 36 and then moves downward. This allows a vertical surface 38 (connected to the second ramp surface 36) in the first upper edge portion 31 to engage a vertical surface 40 in the first lower edge portion 32 of the long side sidewall 15 as illustrated in FIG. 4. This configuration counteracts inward buckling forces which can arise from vertical compressive loads.

The first lower edge portion 32 and first upper edge portion 30 can be positioned proximate a corner of the base. Additional upper/lower edge portions with the described ramp surfaces can be formed along the sidewall 15. Moreover, the opposing long sidewall can include such features.

Figure 7:
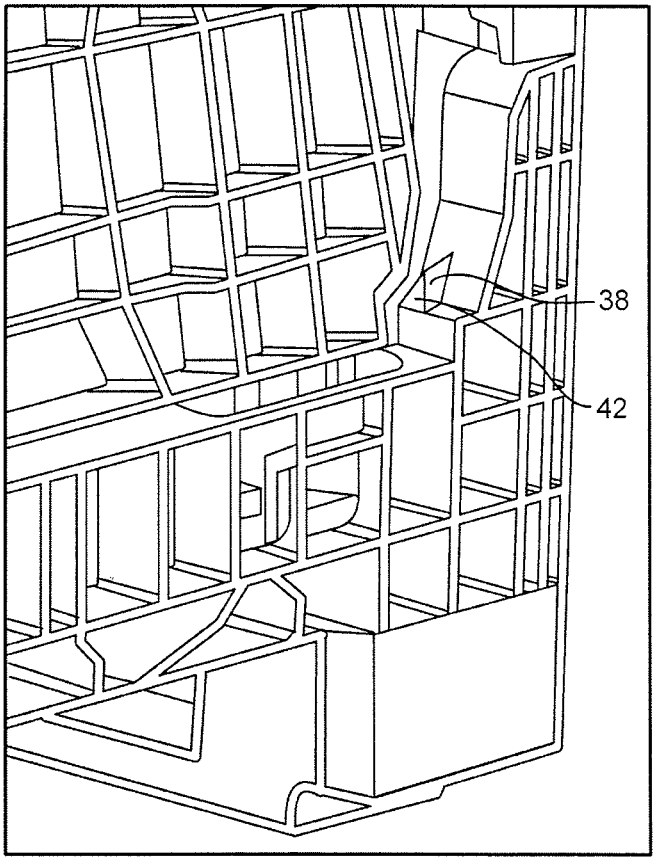

FIG. 7 shows an embodiment of the bulk bin having a bottom ramp 42 in the base 12 which interacts with a ramp surface in the in the bottom of the sidewall positioned along the side of the sidewall 15. The ramp 42 is positioned to contact the bottom of the sidewall 15 proximate one side of the sidewall 15 (another ramp can be positioned on the base portion 12 proximate the other side of the sidewall 15 to interact with a ramp on the bottom of the sidewall on that side). The ramp 42 includes a vertical surface 38 facing toward the exterior of the container 10. The ramp 42 is preferably molded into the base 12.

As discussed above, the ramp 42 is preferably located above the hinge rotation centerline of the sidewall 15. Additionally, it is positioned inward from the outer edge or exterior of the base 12 (i.e., toward the interior or center of the base 12). The ramp 42, and in particular the vertical surface 38, provides an additional benefit of reacting to buckling of the sidewall when subjected to compressive loads from stacking (of other bins or objects).

Again, as discussed above, the ramp 42 is designed to lift the sidewall 15 approximately 0.75 inches as the sidewall 15 is moved to its upright position. Once over the ramp 42 (i.e., nearly upright), the sidewall 12 is forced downward to engage the interlock structure in the wrap-around portions discussed above.

Many modifications and variations of the present invention are possible in light of the above teachings. It is, therefore, to be understood within the scope of the appended claims the invention may be protected otherwise than as specifically described.

We claim:

1. A collapsible bulk bin container comprising:

a base having a first side, a second side, a third side and a fourth side;

a first sidewall pivotably connected to the first side of the base;

a second sidewall pivotably connected to the second side of the base;

a third sidewall pivotably connected to the third side of the base;

a fourth sidewall pivotably connected to the fourth side of the base;

the first sidewall having an outer surface and an inner surface and an edge on a first side perpendicular to the outer surface, the first sidewall connected to a first wrap-around portion at the first side of the first sidewall extending outward beyond the edge of the first sidewall that contacts a first side portion of the second sidewall when the first and second sidewalls are pivoted upright, the first wrap-around portion having a first horizontal plate at a top portion of the first wrap-around portion extending outward over the first wrap-around portion; and, the second sidewall having a lift and lock feature, wherein the lift and lock feature includes the second sidewall having a first lower edge portion with a first ramp surface and the base having an upward projection including a first upper edge portion with a second ramp surface positioned to contact the first ramp surface of the second sidewall, the first ramp surface and second ramp surface configured to lift the second sidewall as the second sidewall is pivoted into an upright position.

2. The collapsible bulk bin container of claim 1 further comprising the first sidewall having a second wrap-around portion at a second side of the first sidewall that contacts a first side portion of the fourth sidewall when the first and fourth sidewalls are pivoted upright, the second wrap-around portion having a second horizontal plate at a top portion extending outward over the second wrap-around portion.

3. The collapsible bulk bin container of claim 2 further comprising a horizontal rib in the first wrap-around portion positioned below the first horizontal plate proximate the top portion of the first wrap-around portion.

4. The collapsible bulk bin container of claim 3 further comprising a horizontal rib in the second wrap-around portion positioned below the second horizontal plate proximate the top portion of the second wrap-around portion.

5. The collapsible bulk bin container of claim 2 further comprising the third sidewall having a first wrap-around portion at a first side of the third sidewall that contacts a second side portion of the second sidewall when the third and second sidewalls are pivoted upright, the first wrap-around portion of the third sidewall having a third horizontal plate extending outward over the first wrap-around portion at a top portion of the first wrap-around portion.

6. The collapsible bulk bin container of claim 5 further comprising the third sidewall having a second wrap-around portion at a second side of the third sidewall that contacts a second side portion of the fourth sidewall when the third and fourth sidewalls are pivoted upright, the second wrap-around portion of the third sidewall having a fourth horizontal plate extending outward over the second wrap-around portion at a top portion of the second wrap-around portion.

7. The collapsible bulk bin container of claim 6 further comprising a horizontal rib in the first wrap-around portion of the third sidewall positioned below the third horizontal plate proximate the top portion of the first wrap-around portion.

8. The collapsible bulk bin container of claim 7 further comprising a horizontal rib in the second wrap-around portion of the third sidewall positioned below the first horizontal plate proximate the top portion of the second wrap-around portion.

9. The collapsible bulk bin container of claim 2 wherein the first wrap-around portion extends at about a 90° angle from the first sidewall.

10. The collapsible bulk bin container of claim 9 wherein the second wrap-around portion extends at about a 90° angle from the first sidewall.

11. The collapsible bulk bin container of claim 1 wherein the first wrap-around portion of the first sidewall includes projections for interlocking with the second sidewall.

12. The collapsible bulk bin container of claim 1 further comprising a vertical surface connected to the second ramp surface.

13. The collapsible bulk bin container of claim 1 wherein the first ramp surface and the second ramp surface are curved.

14. A collapsible bulk bin container comprising:

a plastic base having a first upward projection proximate a first end of a first side;

a plastic first sidewall pivotably connected to the first side of the base, the first sidewall having a first lower edge portion with a first ramp surface and the upward projection having a first upper edge portion with a second ramp surface positioned to contact the first ramp surface of the first sidewall, the first ramp surface and second ramp surface configured to lift the first sidewall as the first sidewall is pivoted into an upright position.

15. The collapsible bulk bin container of claim 14 wherein the first ramp surface of the first lower edge portion of the first sidewall and the second ramp surface of the first upper edge portion of the upward projection are curved.

16. The collapsible bulk bin container of claim 15 wherein the first lower edge portion of the first sidewall has an inwardly vertical surface connected to the first ramp surface.

17. The collapsible bulk bin container of claim 15 further comprising the first side sidewall having a second lower edge portion spaced from the first lower edge portion with a first ramp surface and the base having a second upward projection proximate a second end of the first side of the base, the second upward projection having a second upper edge portion spaced from the first upper edge portion with a second ramp surface positioned to contact the first ramp surface of the second lower edge portion of the first sidewall.

18. The collapsible bulk bin container of claim 14 wherein the first upper edge portion of the upward projection along the first side of the base has an outwardly vertical surface connected to the second ramp surface.

* * * * *